US008313156B2

(12) United States Patent
Ross

(10) Patent No.: US 8,313,156 B2
(45) Date of Patent: Nov. 20, 2012

(54) LCD MONITOR STAND WITH NOTE AND STORAGE AREAS

(76) Inventor: Wilton Leon Ross, E. Alton, IL (US)

( * ) Notice: Subject to any disclaimer, the term of this patent is extended or adjusted under 35 U.S.C. 154(b) by 0 days.

(21) Appl. No.: 12/941,800

(22) Filed: Nov. 8, 2010

(65) Prior Publication Data

US 2012/0112609 A1 May 10, 2012

(51) Int. Cl.
*A47B 88/00* (2006.01)

(52) U.S. Cl. ..... 312/311; 312/223.3

(58) Field of Classification Search ..... 312/223.3, 312/327, 328, 7.2, 230, 348.3, 208.1, 311, 312/295, 310, 330.1, 351.1, 351.3; 248/346.01, 248/346.03, 917, 918, 127
See application file for complete search history.

(56) References Cited

U.S. PATENT DOCUMENTS

| | | | | | |
|---|---|---|---|---|---|
| 1,471,757 | A | * | 10/1923 | Thiriot | 312/208.4 |
| 2,629,644 | A | * | 2/1953 | Heys | 312/286 |
| 2,956,675 | A | * | 10/1960 | Bates et al. | 206/449 |
| 3,271,092 | A | * | 9/1966 | Hatfield et al. | 312/311 |
| 3,353,886 | A | * | 11/1967 | Tompkins | 312/400 |
| 4,496,200 | A | * | 1/1985 | Hagstrom et al. | 312/223.3 |
| 4,603,925 | A | * | 8/1986 | Cuevas-Cumming | 312/196 |
| 4,657,214 | A | * | 4/1987 | Foster | 248/176.1 |
| 4,834,470 | A | * | 5/1989 | Pinnow et al. | 312/311 |
| 5,080,452 | A | * | 1/1992 | Tuckman | 312/242 |
| 5,437,235 | A | * | 8/1995 | Randolph | 108/25 |
| 5,611,608 | A | * | 3/1997 | Clausen | 312/223.3 |
| 5,725,189 | A | * | 3/1998 | Landy | 248/205.2 |
| 5,743,605 | A | * | 4/1998 | Marino | 312/211 |
| 5,979,337 | A | * | 11/1999 | Clark et al. | 108/43 |
| 6,036,288 | A | * | 3/2000 | Shih | 312/223.3 |
| 6,092,672 | A | * | 7/2000 | Harris et al. | 211/11 |
| 6,109,585 | A | * | 8/2000 | Burch, Jr. | 248/442.2 |
| 6,398,178 | B1 | * | 6/2002 | Azola et al. | 248/442.2 |
| 6,493,220 | B1 | * | 12/2002 | Clark et al. | 361/679.41 |
| 6,686,900 | B1 | * | 2/2004 | Levy et al. | 345/156 |
| 6,721,178 | B1 | * | 4/2004 | Clark et al. | 361/679.4 |
| 7,278,613 | B2 | * | 10/2007 | Roy | 248/49 |
| 2001/0013304 | A1 | * | 8/2001 | Davis et al. | 108/6 |
| 2003/0177682 | A1 | * | 9/2003 | Bing et al. | 40/658 |
| 2004/0178317 | A1 | * | 9/2004 | Ramey et al. | 248/441.1 |
| 2005/0105260 | A1 | * | 5/2005 | Lee | 361/683 |
| 2005/0211863 | A1 | * | 9/2005 | Masi | 248/442.2 |
| 2006/0014132 | A1 | * | 1/2006 | Hamilton | 434/365 |
| 2007/0247037 | A1 | * | 10/2007 | Schenker | 312/223.6 |
| 2008/0001043 | A1 | * | 1/2008 | Meyer | 248/129 |
| 2009/0184614 | A1 | * | 7/2009 | Walsberg | 312/351.3 |

* cited by examiner

*Primary Examiner* — Darnell Jayne
*Assistant Examiner* — Hiwot Tefera
(74) *Attorney, Agent, or Firm* — Don W. Weber

(57) ABSTRACT

A stand for an LCD monitor includes a storage area and a front message center. The stand is box-shaped and has a flat top for the monitor. The sides are shaped like a trapezoid such that the hinged front door is slanted downwards and towards the user. The outer surface of the front door has a left dry erase side for writing notes and a right cork board side for posting messages. The inside of the stand has one or more sliding drawers with a variety of compartments for storing articles like pens and paper clips. The lower section of the inside of the stand also has convenient storage space. Lower adjustable feet allow the user to adjust the height of the monitor. A cup holder or phone holder can also be included on the top.

3 Claims, 4 Drawing Sheets

LCD MONITOR STAND WITH NOTE AND STORAGE AREAS

BACKGROUND OF THE INVENTION

This invention relates to the field of monitor stands for LCD monitor displays. More particularly, an LCD monitor stand is presented that has both an outer note posting surface and an inner storage are with drawers.

Many computers are modular in the sense that they have a stack for the internal components of the system and a separate monitor stand These monitors are stand-alone screens that are placed near the stack and are electrically connected by cables. The monitor is usually placed on a desk or table near the stack and is at a selected height as a result of the sot height of the desk or table.

It has been a standard practice in this field to provide monitor stands to support the monitor. Over 11,000 such monitor stands are known and they come in many different shapes and configurations.

A good example of the type of stand currently in use is the 2010 United States patent issued to Kim (U.S. Pat. No. 7,694,922) for a supporting apparatus for display devices. Kim describes a support device including a supporting bracket connected to a base and a flat stand. The monitor is fastened to the apparatus which may be moved and set in different directions. While Kim provides a support bracket capable of moving the monitor into different positions on a table, it does not provide any storage space. It is an object of this invention to provide a monitor stand that not only supports the monitor but also provides storage space for paper, pencils, paper clips or other commonly used office supplies within the stand.

Another patent in the general field of monitor stands was disclosed by Lu, U.S. Pat. No. 6,581,893. Lu's monitor stand includes a bracket that can be pivoted relative to the base so that the LCD monitor is folded to reduce its overall volume for packing, storing or transporting. Similarly, the U.S. patent issued to Rawlings in 2005 (U.S. Pat. No. 6,874,744) shows a stand that allows the user to place the monitor in a variety of physical orientations.

It is another object of this invention to provide a monitor stand that has a lower compartment with drawers for storage. The body of the stand raises the height of the monitor closer to the eye level of the user. The body has storage room for office supplies, notes and other types of commonly used articles.

A further feature and object of this invention is to provide a message center on the front of the body of the stand for placing notes or other messages or reminders. This is accomplished by having the left half of the front of the stand with a dry erase board and the right half with a cork board. The user can write messages on the left half and post notes on the right half of the front of the stand. It is a still further object of this invention to provide a message center as part of a monitor stand to enable the user to post notes or other reminders thereon.

Further and other objects of this invention will become obvious upon reading the below description and reviewing the drawings.

BRIEF DESCRIPTION OF THE INVENTION

An LCD monitor stand for supporting an LCD monitor has a hollow body or box with a hinged front panel. The outer surface of the front panel is divided into left and right sides. The left side has a dry-erase board for making notes. The outer surface of the right side has a cork board surface for posting notes using tacks. The inner area of the stand has an upper slidable drawer. This drawer is divided into different sized areas for storing paper, paper clips, pens or markers or any other type of articles desired. The lower surface of the stand can be used to store paper or other, larger articles.

BRIEF DESCRIPTION OF THE DRAWINGS

FIG. 4 also shows that the stand may have more than one slidable drawer.

DETAILED DESCRIPTION OF THE INVENTION

Figure 1:
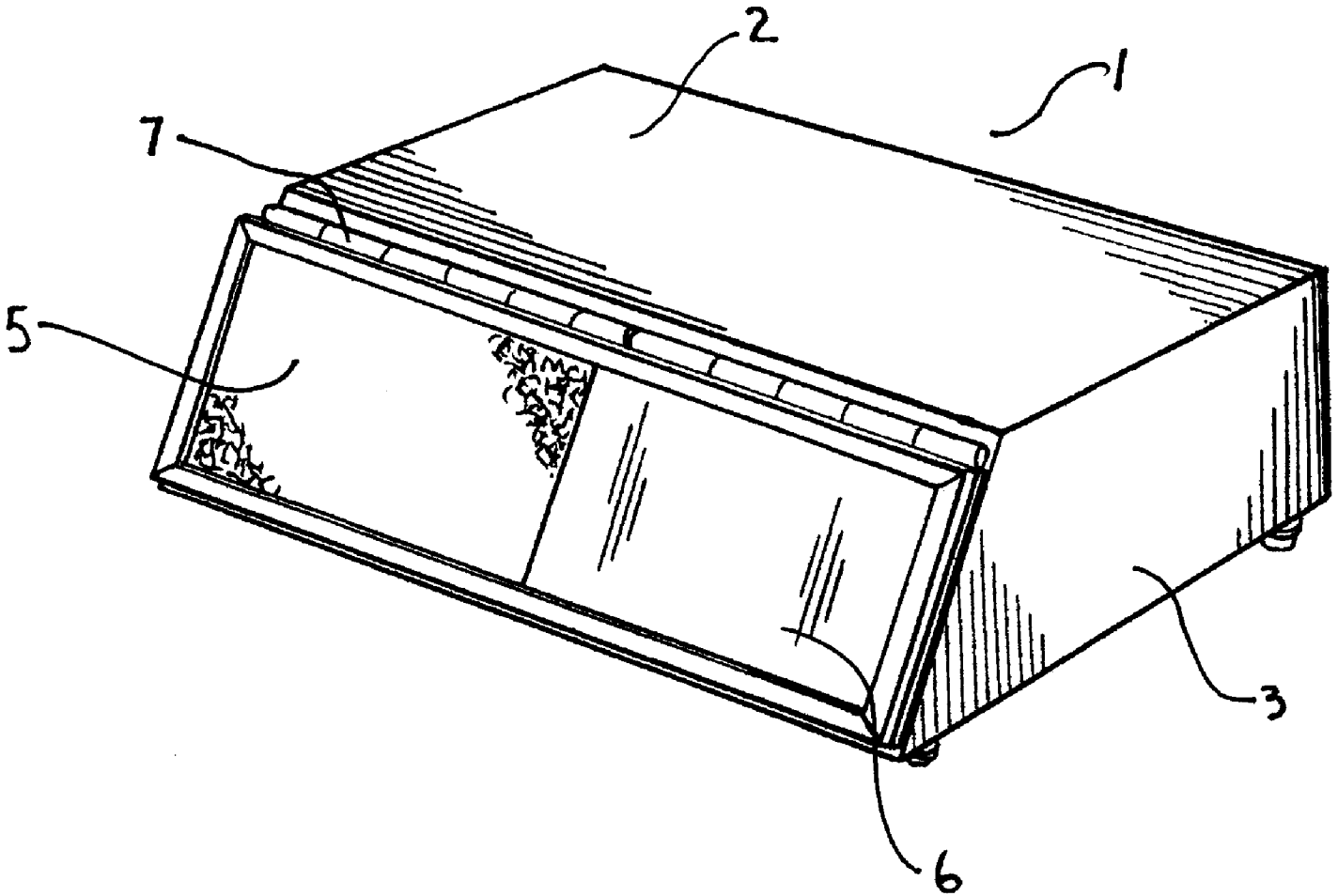
FIG. 1 is a perspective view of the stand.

An LCD monitor stand and storage box 1 is presented. The stand has an essentially flat horizontal top 2 for receiving a monitor stand 14. The body has an essentially horizontal bottom with essentially vertical sides and a back attached to the top and bottom. In the preferred embodiment, the sides 3 of the hollow body of the stand 1 have a trapezoidal shape as best shown on FIGS. 1 and 4. The trapezoidal opposite sides 3 have a functional purpose in that this geometric shape allows for the hinged front section 4 to slant upwards towards the user.

Figure 2:
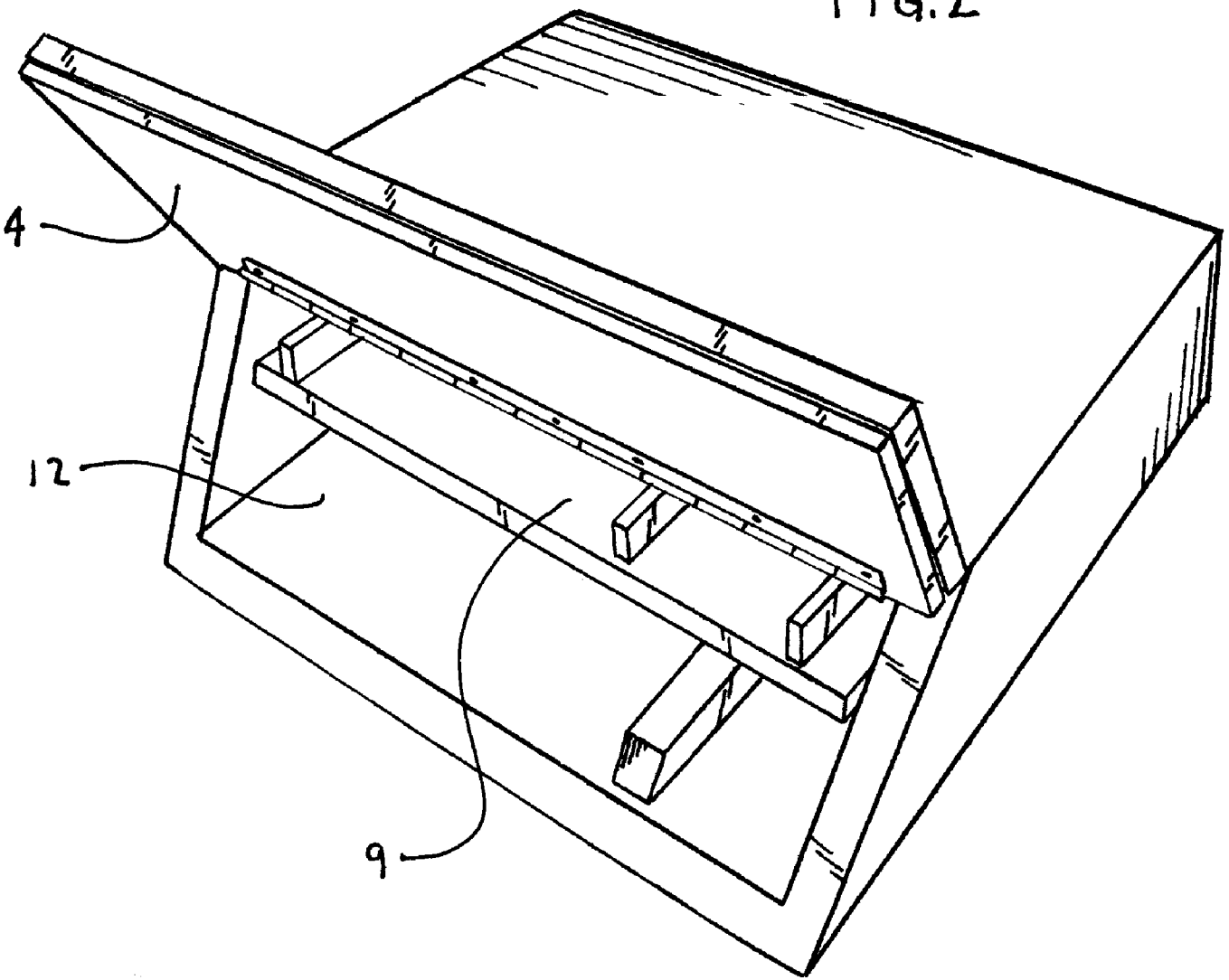
FIG. 2 is a perspective view of the stand showing the front panel open and the inner area of the stand.
Figure 3:
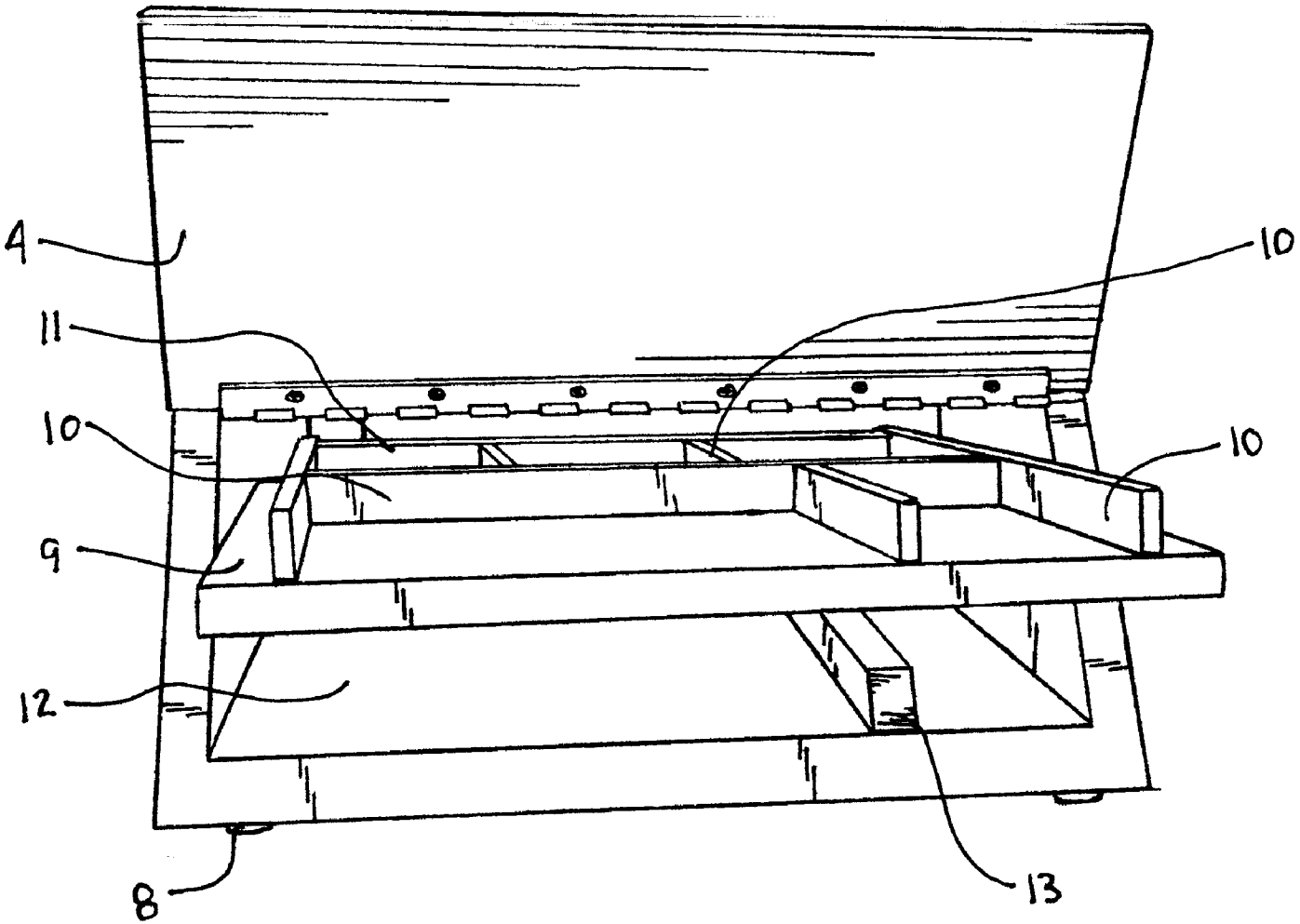
FIG. 3 is a front perspective view of the stand with the front panel open showing the configuration of the inner part of the stand.

The front panel 4 is hinged and is attached to the top 2 of the body at the top edge of the front panel as shown in FIGS. 1, 2 and 3. This front panel 4 is divided into two areas 5 and 6 as shown in FIG. 1. The outer surface of the left side 5 of the front panel consists of a dry-erase board and car be used for writing memos or reminders. The outer surface of the right side 6 of the front panel consists of cork board or other suitable material. This cork board side can be use for tacking notes or other reminders.

It is to be appreciated that the outer message surface of the front panel 4 may be all one type of surface (dry-erase or cork board) or could consist of other types of convenient surfaces, such as Velcro® or magnetic surfaces or similar attaching means. Also, there can be several types of surfaces on the front panel. The two surfaces described herein are meant as an illustration only and not as a limitation to this invention and disclosure.

The top edge of the front panel 4 is hingedly and rotatably attached to the front edge of the top 2 by hinge 7. The hinge 7 may be an elongated continuous hinge as shown or may consist of two or more hinges. The hinge allows the user to rotate the front panel 4 upwards as best shown in FIGS. 2 and 3 in order to access the inner part of the stand.

The stand body also has adjustable feet 8 located on the lower surface of each bottom corner of the stand. These adjustable feet have screw-type height adjustments such that the height of the stand from the desk or table surface can be adjusted to suit the needs of the user.

Figure 4:
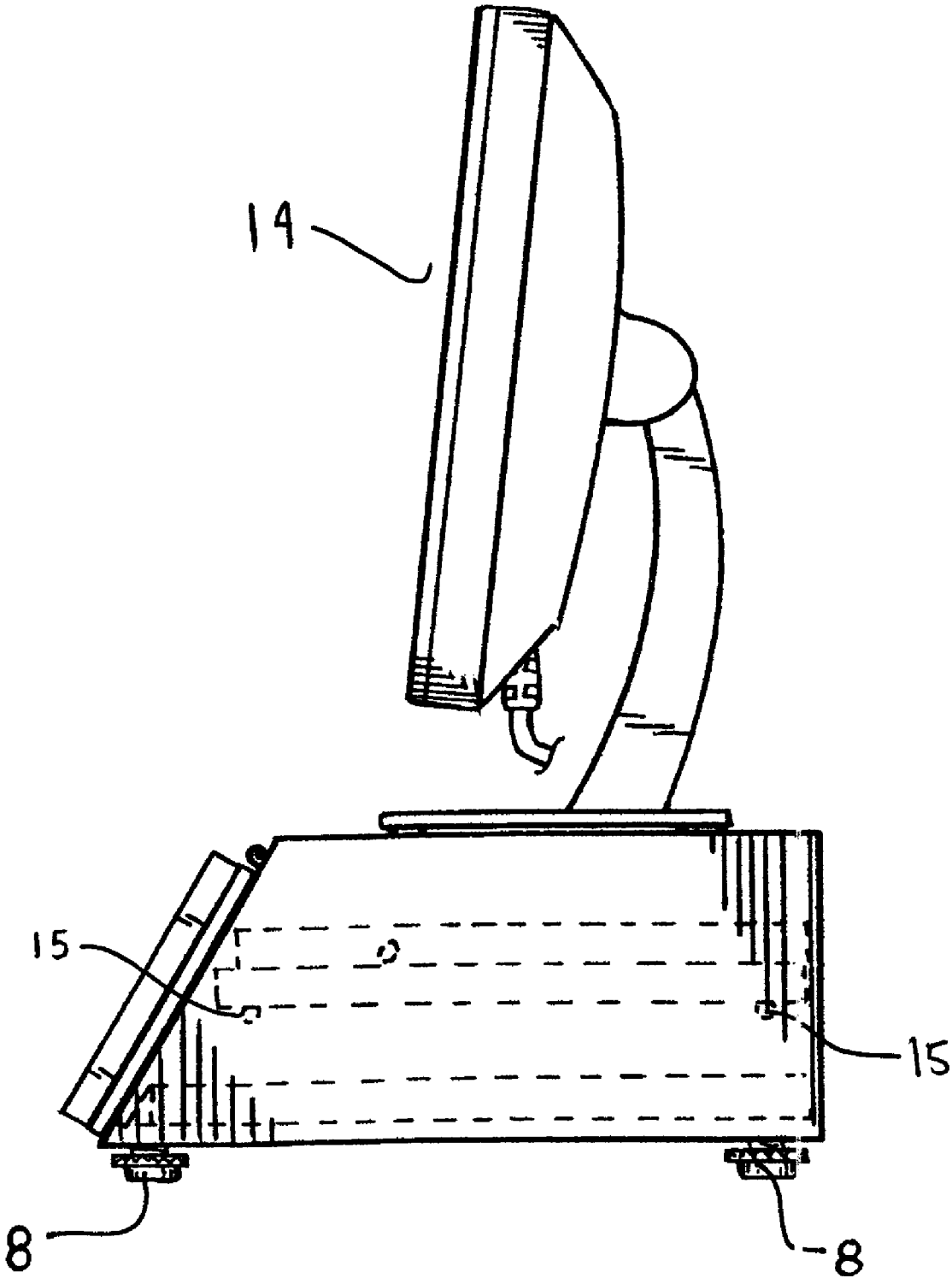
FIG. 4 is a side view of the stand shown with the monitor on the stand.

Turning now to FIGS. 2 and 3, the inner part of the stand body is shown. The inner part of the stand body is hollow and may contain one or more drawers. In FIGS. 2 and 3 one drawer is shown. However, two drawers as shown in FIG. 4 may also be placed inside of the body. The number of drawers is optional and one or more drawers are within the spirit of the disclosure of this invention.

The upper slidable drawer 9 shown in FIG. 2 is divided into several different compartments by drawer partitions 10.

These partitions as shown in FIG. 2 divide the drawer into 5 sections in the preferred embodiment. However, other configurations of the compartments are within the spirit and disclosure herein. The drawer could have only two compartments or many compartments depending on the preferences of the user. These compartments can be configured to store pens or pencils, markers for the dry-erase board, tacks for the cork board section of the front panel, or for other suitable items. The rear edge of the inner drawer 9 has a rear edge partition 11 to prevent any stored items from falling from the drawer.

In the preferred embodiment, the upper drawer is slidable. The upper drawer 9 may slide on pegs 15 as shown in FIG. 4. Alternatively, the drawer 9 may use channels and rails as is commonly known in the field.

The drawer 9 can also be turned upside down to allow for a flat surface for storage or it could be used with the partitions 10 up as shown. In addition, two slidable drawers can be provided instead of one.

The lower surface of the inner part of the stand body may also contain a partition 13 as shown in FIGS. 3 and 4. This lower partition, as well as the upper drawer partitions 10 are optional with the user and may be adjusted or arranged to suit the needs of the end user. The lower storage area 12 may be conveniently used for storing larger items such as paper.

The stand 1 is used by placing it on a desk or table and adjusting the feet 8 such that the monitor will be at a desirable level. The monitor 14 is positioned on the stand as best shown in FIG. 4. The stand 1 supports the LCD monitor and also provides a message board front panel 4 and a storage drawer and lower storage area as shown and described.

In the preferred embodiment, the stand body is approximately 12 inches across the front, 10 inches deep and approximately 5 inches high for a standard 18.5-20 inch size monitor. The stand would need to be wider for larger monitors. Obviously, larger dimensions for larger monitors are within the spirit of this disclosure.

The front panel 4 slopes forwardly and downwardly at an approximate 40 degree angle An alternate indented area holder for a cup or a phone can also be provided near the front of the top surface of the top 2 as another enhancement of the stand. It is also within the contemplation aid spirit of this invention to add additional enhancements such as one or more USB ports, wire portals, or other features.

While the preferred cross-section of the stand is trapezoidal, the stand could have other shapes while still keeping within the spirit and disclosure of this invention. The above dimensions, angles, number of drawers and other features as noted are meant a san illustration only and not as a limitation on the disclosure.

Having fully described my device, I claim:

1. A stand for an LCD monitor comprising:

(a) a hollow body having an essentially horizontal top and bottom, wherein said bottom is longer than said top, essentially vertical sides, wherein the bottom of said sides is longer than the top of said sides, wherein said sides are trapezoidal, and a back attached to said top and bottom, further comprising a slanted front planar door hingedly attached to the upper front edge of said top, sloping upwardly and rearwardly, such that the front surface of said slanted planar door is slanted upwardly and rearwardly in the closed position an adjustable partition fixed to the upper, inner surface of said bottom to create a storage area;

(b) at least one inner, slidable drawer located inside said body, wherein said at least one drawer is divided into a plurality of different compartments to store items wherein said at least one drawer is capable of being pulled out when said slanted planar front door is in the open position and wherein said drawer is capable of being turned upside down to allow for a flat surface for storage;

(c) a message surface on said upwardly and rearwardly sloping slanted front, wherein the outer surface of said slanted front comprises a left half having a dry erase surface and a right half having a cork board surface;

(d) adjustable screw-type feet located on the lower surface of each bottom corner of said stand whereby the height of the stand is capable of being adjusted.

2. A stand for an LCD monitor as in claim 1 further comprising an indented area on the top surface of the top for holding a cup or phone.

3. A stand for an LCD monitor as in claim 1 further including a hook-and-pile surface and a magnetic surface for attaching notes or other items to said message surface.

* * * * *